US006701677B2

(12) United States Patent
Gresham et al.

(10) Patent No.: US 6,701,677 B2
(45) Date of Patent: Mar. 9, 2004

(54) PARTITION COVERING WITH POCKET

(75) Inventors: David M. Gresham, E. Grand Rapids, MI (US); James N. Ludwig, E. Grand Rapids, MI (US); Karl J. Mead, E. Grand Rapids, MI (US); Karl Heinz Mueller, E. Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 34 days.

(21) Appl. No.: 10/113,129

(22) Filed: Mar. 29, 2002

(65) Prior Publication Data

US 2003/0182872 A1 Oct. 2, 2003

(51) Int. Cl.[7] ..... E04H 1/00; E04F 17/08

(52) U.S. Cl. ..... 52/36.1; 52/220.7; 52/239; 52/741.1

(58) Field of Search ..... 52/36.1, 36.4, 52/36.5, 220.7, 220.8, 481.2, 239, 63, 222, 741.1

(56) References Cited

U.S. PATENT DOCUMENTS

| | | | | |
|---|---|---|---|---|
| 3,121,977 | A | | 2/1964 | Bersudsky |
| 3,251,399 | A | * | 5/1966 | Grossman |
| 3,780,479 | A | * | 12/1973 | Billarant et al. |
| 3,852,935 | A | | 12/1974 | Jones |
| 3,863,412 | A | | 2/1975 | Bodycomb et al. |
| 3,986,312 | A | | 10/1976 | Calhoun et al. |
| 4,028,855 | A | | 6/1977 | Prewer |
| 4,041,667 | A | | 8/1977 | Lindner et al. |
| 4,067,346 | A | * | 1/1978 | Husted |
| 4,068,428 | A | * | 1/1978 | Peterson, III |
| 4,094,561 | A | | 6/1978 | Wolff et al. |
| 4,118,903 | A | | 10/1978 | Couthard |
| 4,224,769 | A | | 9/1980 | Ball et al. |
| 4,249,589 | A | * | 2/1981 | Loeb |
| 4,323,291 | A | | 4/1982 | Ball |
| 4,325,197 | A | * | 4/1982 | Achten et al. |
| 4,372,629 | A | | 2/1983 | Propst et al. |
| 4,430,835 | A | | 2/1984 | Ericson |
| 4,462,193 | A | | 7/1984 | Ericson |
| 4,471,548 | A | | 9/1984 | Goudie |
| 4,493,174 | A | | 1/1985 | Arens |
| 4,535,703 | A | | 8/1985 | Henriott et al. |
| 4,562,675 | A | * | 1/1986 | Baigas, Jr. et al. |
| 4,601,137 | A | | 7/1986 | Bates |
| 4,631,881 | A | | 12/1986 | Charman |
| 4,635,418 | A | | 1/1987 | Hobgood |
| 4,656,766 | A | * | 4/1987 | Cooper |
| 4,734,826 | A | | 3/1988 | Wilson et al. |
| 4,744,189 | A | | 5/1988 | Wilson |
| 4,792,881 | A | | 12/1988 | Wilson et al. |
| 4,841,699 | A | | 6/1989 | Wilson et al. |
| 4,862,659 | A | | 9/1989 | Wilson et al. |
| 4,873,773 | A | * | 10/1989 | Canonge |

(List continued on next page.)

FOREIGN PATENT DOCUMENTS

| | | | |
|---|---|---|---|
| JP | 4-124378 | * | 4/1992 |

*Primary Examiner*—Robert Canfield
(74) *Attorney, Agent, or Firm*—Price, Heneveld, Cooper, DeWitt & Litton, LLP

(57) ABSTRACT

A partition includes a partition frame having a face and a cavity behind the face, and a covering attached to the partition frame that aesthetically covers the face. The covering includes an access slit through which the cavity can be accessed, and is sufficiently flexible so that the slit can be opened to access the cavity. A pouch can be attached to the covering material along the slit, so that a purse-like pouch is created for holding personal items and/or excess electrical wiring. A zipper or closure device can be used on the access slit. In one form, the skin is releasably attached with hook-and-loop material, so that a corner of the skin can be pulled loose for accessing the cavity.

26 Claims, 4 Drawing Sheets

U.S. PATENT DOCUMENTS 4,874,322 A 10/1989 Dola et al.
4,884,589 A * 12/1989 Simpson
4,974,384 A 12/1990 Pacione
5,007,473 A 4/1991 Evensen
5,060,443 A 10/1991 Pacione
5,144,896 A 9/1992 Fortsch
5,172,529 A 12/1992 Van De Riet
5,172,530 A * 12/1992 Fishel et al.
5,235,789 A 8/1993 Rackowski
5,238,515 A 8/1993 Insalaco et al.
5,272,988 A 12/1993 Kelley et al.
5,277,006 A 1/1994 Ruster
5,277,131 A 1/1994 Fortsch
5,305,567 A 4/1994 Wittler
5,310,031 A * 5/1994 Plath
5,323,835 A 6/1994 Bachmeier
5,352,149 A 10/1994 Melashenko et al.
5,368,085 A * 11/1994 Ruparelia
5,375,641 A 12/1994 Schlueter
5,406,760 A 4/1995 Edwards
5,414,950 A 5/1995 Johnson, Sr.
5,428,928 A 7/1995 Hellwig et al.
5,433,046 A 7/1995 MacQuarrie et al.
5,473,994 A 12/1995 Foley et al.
5,495,952 A 3/1996 Kainz
5,606,919 A 3/1997 Fox et al.
5,809,900 A 9/1998 Alexander et al.
5,833,332 A 11/1998 Marshall et al.
5,875,594 A 3/1999 Hellwig et al.
5,970,662 A 10/1999 Corcorran et al.
5,974,742 A 11/1999 Schreiner et al.
5,974,753 A 11/1999 Hsu
6,065,258 A 5/2000 McClatchy
6,076,317 A 6/2000 Hellwig et al.
6,176,561 B1 1/2001 Roels et al.
6,192,805 B1 2/2001 Saylor et al.
6,253,509 B1 * 7/2001 Hellwig et al.
6,254,206 B1 7/2001 Petrick et al.
6,336,232 B1 * 1/2002 Toder
6,374,548 B1 4/2002 Ruedinger et al.
6,388,190 B1 * 5/2002 Laukhuf et al.

* cited by examiner

PARTITION COVERING WITH POCKET

BACKGROUND

The present invention relates to partitions with aesthetically covered side surfaces, and more particularly relates to partitions with side coverings adapted with features to optimize a workstation for efficiency and to customize a workstation for individuality.

Partitions are often used to subdivide building space into work areas and office arrangements. Building space is expensive, and accordingly, it is important to make optimal and efficient use of every part of a work area. Further, especially as offices and work areas become smaller, it is important to reduce clutter and to provide places for storage of important papers and personal effects.

Another problem occurs when multiple electrical devices are placed on a worksurface in a work area. Electrical devices such as computer monitors and keyboards, speakers, telephones, and battery-operated devices (such as CD players, radios, cell-phone chargers, and the like) each have one or more wires that extend from the device across the worksurface. The wires not only take up space on the worksurface, but also look bad, get in the way, and give the overall appearance of a messy unkept work area.

An apparatus is desired solving the aforementioned problems and having the aforementioned advantages.

SUMMARY OF THE PRESENT INVENTION

In one aspect of the present invention, a partition includes a partition frame having a face and a cavity behind the face, and a covering attached to the partition frame that aesthetically covers the face. The covering includes an access slit through which the cavity can be accessed, and is sufficiently flexible so that the slit can be opened to access the cavity.

In another aspect of the present invention, a partition includes a partition frame having a face and a cavity behind the face. A covering is attached to the partition frame that aesthetically covers the face. The covering includes an access opening through which the cavity can be accessed. A pouch is provided that is shaped and adapted to hold items in the cavity that are dropped through the access opening.

In another aspect of the present invention, a partition includes a partition frame having frame members defining a face and that define a cavity behind the face. A covering is attached to the frame members for aesthetically covering the face. The covering is flexible and attached to the frame members with hook and loop material, such that a corner of the covering can be pulled away for accessing the cavity.

In yet another aspect of the present invention, a method comprises steps of providing a partition frame having a face and a cavity behind the face, a covering with an access opening for the cavity, and a pouch in the cavity that is shaped and adapted to hold items placed in the cavity. The method further includes providing a worksurface adjacent the partition frame. The method also includes supporting an electrical appliance on the worksurface, including placing excess wiring from the electrical appliance through the access opening into the pouch.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 4:
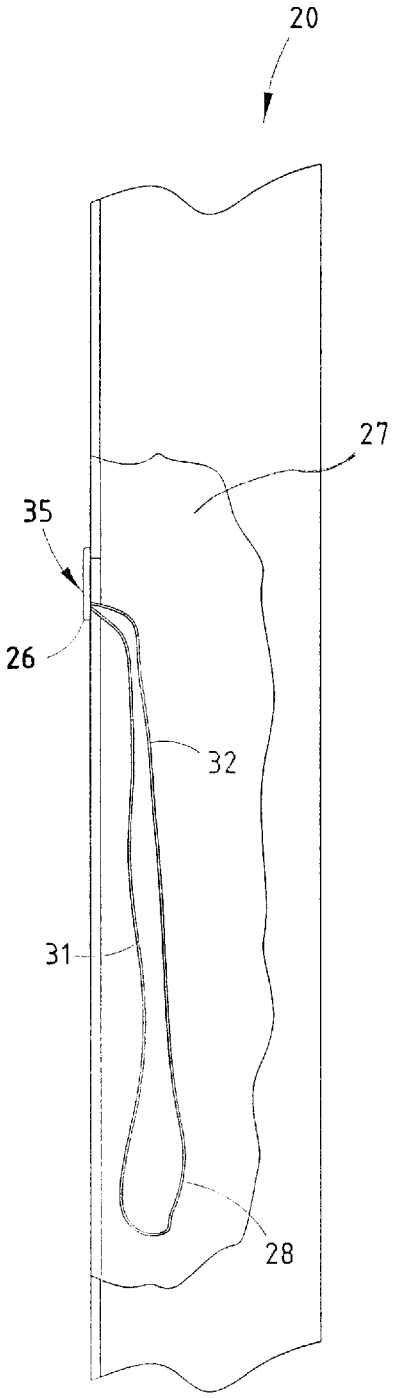
FIG. 4 is a side cross-section taken vertically along the lines IV—IV in FIG. 1.
Figure 4A:
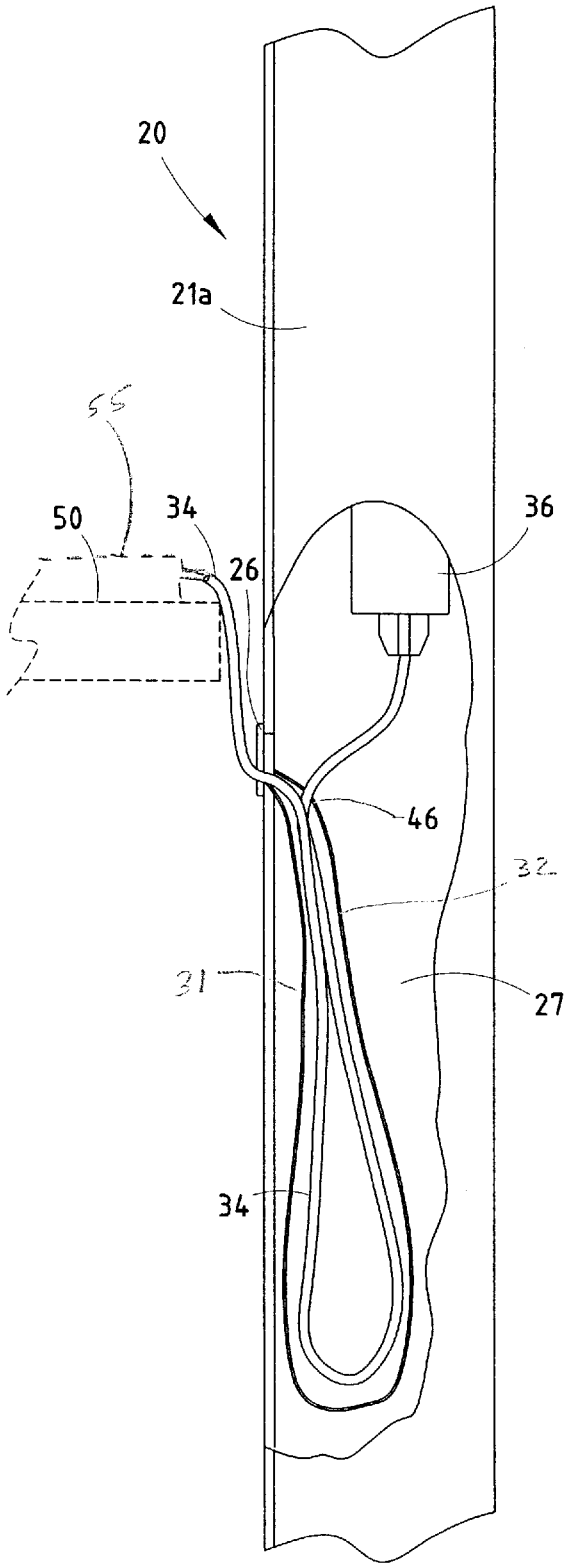
FIG. 4A is a side cross section similar to FIG. 4, but showing an electrical device on a worksurface, including excess wiring stored in the pouch in the partition and showing the wiring extending through a back hole in the pouch and into engagement with an electrical outlet in the internal cavity of the partition.

A partition 20 (FIG. 1) includes a partition frame 21 having perimeter frame members 21A–21D with front surfaces forming a face, and a covering 23 attached to the face with hook and loop material 24 and 25. The covering 23 is flexible and includes an access slit or opening 26 through which an internal cavity 27 defined within the frame 21 can be accessed. In the illustrated embodiment, a pouch 28 (FIG. 4) is formed by a sheet of material, with edges of the sheet attached to the covering material along the top and bottom of the slit 26, and with a middle of the sheet 28 draping downwardly. Right and left edges 29 and 30 (FIG. 2) of the sheet are sewn together so that the purse-like pouch 28 with front and rear walls 31 and 32 is connected to top and bottom edges of slit 26, and is adapted to securely hold personal items and/or excess electrical wires 34. A closure device, such as a zipper 35, can be used to close the pouch 28 for optimal security and aesthetics. In one form, the covering 23 comprises a flexible skin that can be pulled loose at its corner(s) for accessing the cavity 27 and/or the pouch 28 (see FIG. 2). In another form, the pouch 28 is eliminated or the pouch 28 includes a secondary slit 46 (FIG. 4A) in its rear wall 32 50 that wires 34 can be routed to a utility outlet, such as a power outlet 36 located in the cavity 27 of the partition 20. Optionally, the horizontal slit 26 can be located at or slightly below a worksurface 50 (see FIG. 1) or slightly above a worksurface 50A (see FIG. 1A), so that it is easily accessed and so that wires can be easily routed into and out of the pouch 28, although different orientations and positions of the slit and zipper are contemplated (see FIG. 5) and are believed to be included in a scope of the present inventive concepts.

Partitions are well known in the art, and are often used to form office arrangements. The illustrated partitions 20 are connected in-line or in T-shaped arrangements to form the illustrated office arrangement, but of course, different configurations are possible. Specifically, it will be clear to a person skilled in this art that the partitions can be arranged in many different configurations, and that many different partition structures and arrangements are possible while still utilizing the principles of the present inventive concepts.

The illustrated partition 20 (FIG. 1) is described in sufficient detail below for an understanding of the present invention. Nonetheless, if additional discussion of the partition 20 is desired, it can be obtained from the following patent applications, the entire contents of which are incorporated herein by reference: commonly-assigned application Ser. No. 10/077,553, filed Feb. 15, 2002, entitled PANEL SYSTEM, and commonly assigned application Ser. No. 10/076,709, filed Feb. 15, 2002, entitled PARTITION PANEL WITH MODULAR APPLIANCE MOUNTING ARRANGEMENT.

Partition frame members 21A–21D (FIG. 1) are U-shaped channel members attached together to form a rigid "picture-frame" or perimeter. Additional horizontal frame members can be attached between the vertical side frame members 21A and 21C if desired, depending on the height and functional requirements of the partition 20. The top and ends of the partitions 20 are covered with trim for aesthetics. Strips of hook and loop material 25 are applied along the front surfaces of the frame members 21A–21D.

The covering 23 comprises a sheet of flexible upholstery material or fabric shaped to cover the face of the partition frame 21. The covering 23 includes mating hook and loop material 24 along its edges (FIG. 2), in locations matching the pattern of hook and loop material 25. The materials 24 and 25 can be continuous strips, or can be patches located at corners and intermittently along the rectangular perimeter pattern of the frame 21 and the covering 23. Notably, it is contemplated that the hook and loop material 24–25 can be replaced with snaps 24'–25' (see FIG. 5), or replace with other means such as other mechanical fasteners, releasable magnetic material, adhesive, or other means known in the art. Alternatively, the covering 23 can be permanently attached to the partition frame 21, or can be part of a rigid removable cover panel. In the example of a rigid cover panel, the panel would include a board-like sheet of stiff material with an access opening large enough to reach through, and the flexible covering material would cover the board-like sheet of stiff material and at least partially cover the opening while still allowing access through the opening. The pouch, if present, would be attached to the covering 23 and extend through the opening, or the pouch would be formed on a backside of the board-like sheet of stiff material at the opening. Alternatively, the board-like sheet of stiff material can include an outer surface that is treated to be satisfactory as a visual covering, and the pouch can be attached to the board-like sheet of stiff material without a separate upholstery or fabric covering attached to it.

The material of the illustrated covering 23 is tough and able to support the mating elongated zipper elements 40 and 41 of zipper 35 (FIG. 3), and to support the action of a zipper body 42 as it is moved along zipper elements 40–41 to close (or open) the slit 26. Two such zipper bodies 42 can be used, if desired, each including a handle for easy grasping. Where two zipper bodies 42 are used, the location where they meet forms the entrance for wires into the pouch 28, such that the entrance can be located anywhere along the zipper elements 40–41 and along the slit 26.

Figure 3:
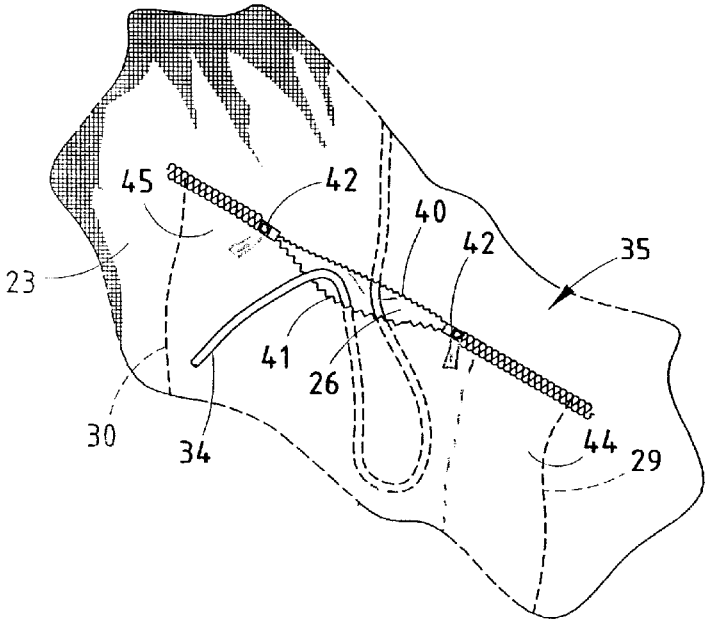
FIG. 3 is an enlarged fragmentary view of the covering.

It is contemplated that the pouch 28 can be subdivided so as to create more than one pocket if desired, such as the illustrated right and left pockets 44 and 45 (FIG. 3). For example, this can be useful to segregate materials stored in the pouch 28. As illustrated in FIG. 3, the right pocket 45 contains personal items 33, such as the illustrated purse, while the left pocket 44 holds the wires 34. The pockets 44 and 45 can also be used for separating different wires, such as wires for electrical power and separate wires for communication/data transfer. Where partition 20 is modified to include an internal utility outlet, such as an intermediate frame member carrying an electrical power outlet 36 (FIG. 4A), a rear (secondary) access slit or opening 46 is cut into the rear wall 32 to allow access to the outlet 36 through the pouch 28. Thus, excess wiring can be stored in the pouch 28, with enough wiring extending forward to the electrical appliance 55 on the worksurface, and with enough wiring extending rearward to the utility outlet. Where the pouch 28 is subdivided, communication wiring can be placed on one side, and wiring for electrical power can be separated and placed on the other side of the pouch.

Figure 1:
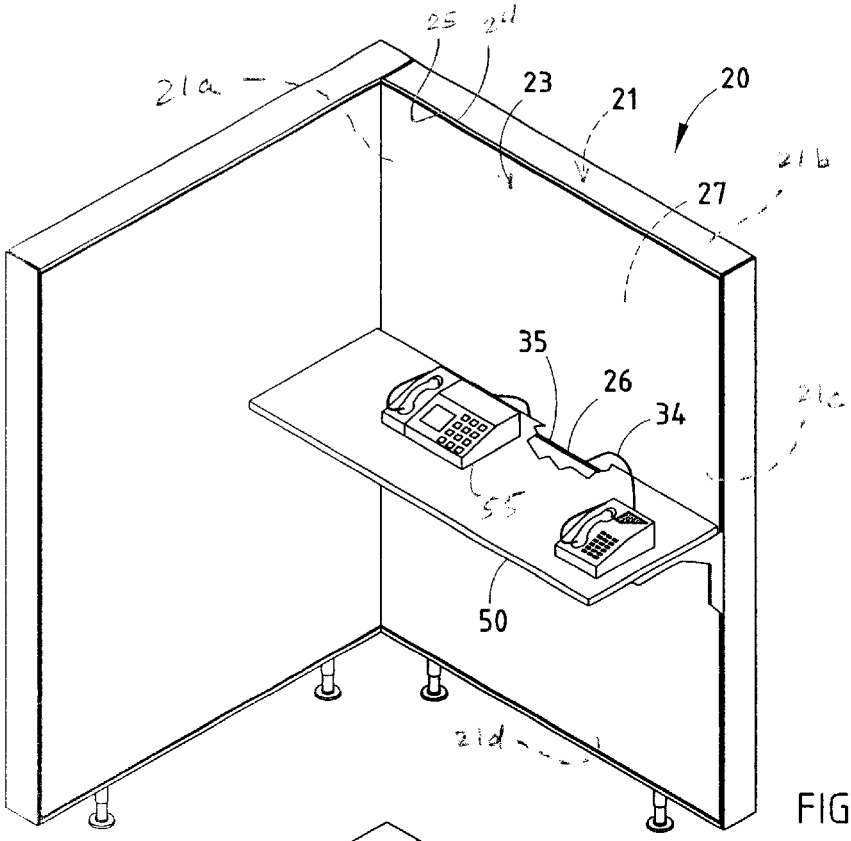
FIG. 1 is a perspective view of a workstation including a partition with an internal cavity and a skin covering having a zippered horizontal slit for accessing a pouch located in the cavity.
Figure 1A:
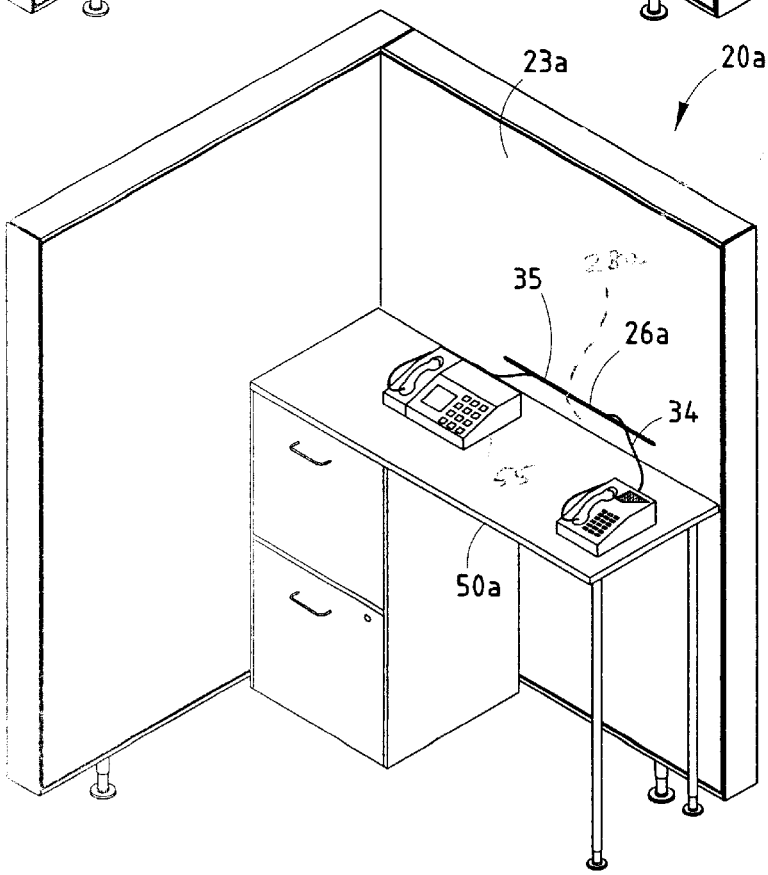
FIG. 1A is a view similar to FIG. 1, but showing a freestanding desk next to a partition, the partition including a horizontal slit for accessing a cavity in the partition.
Figure 2:
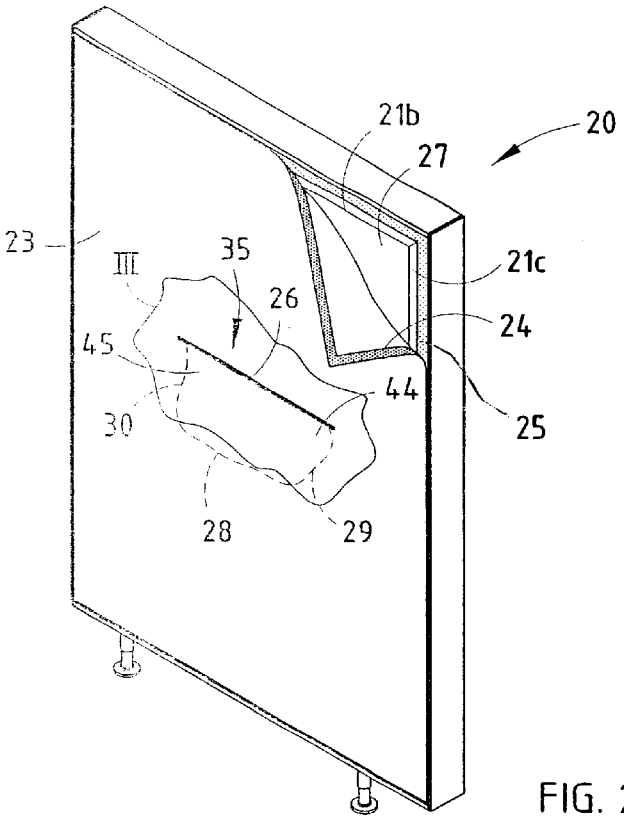
FIG. 2 is a perspective view similar to FIG. 1, but with the worksurface removed to show the covering and the pouch.

The illustrated work area in FIG. 1 includes a worksurface 50 attached in cantilever to the partition 20. The worksurface 50 includes a rear edge spaced about an inch or so forward of the covering 23. The access slit 26 in FIG. 1 is positioned about one or two inches below a top of the worksurface 50. This partially hides the access slit 26 for aesthetics. Further, the covering 23 flexes to permit access to the slit 26. However, it is contemplated that the access slit 26 can be located above a top of the worksurface if desired. For example, see FIG. 1A, which discloses a freestanding desk 50*a* with a worksurface. Notably, the freestanding desk 50*a* can be easily located any distance from the partition 20, thus allowing a worker to position the desk at an optimal distance from the access slit 26*a* of covering 23*a* on the partition 20*a*, depending on what is being stored in the pouch 28*a*.

Figure 5:
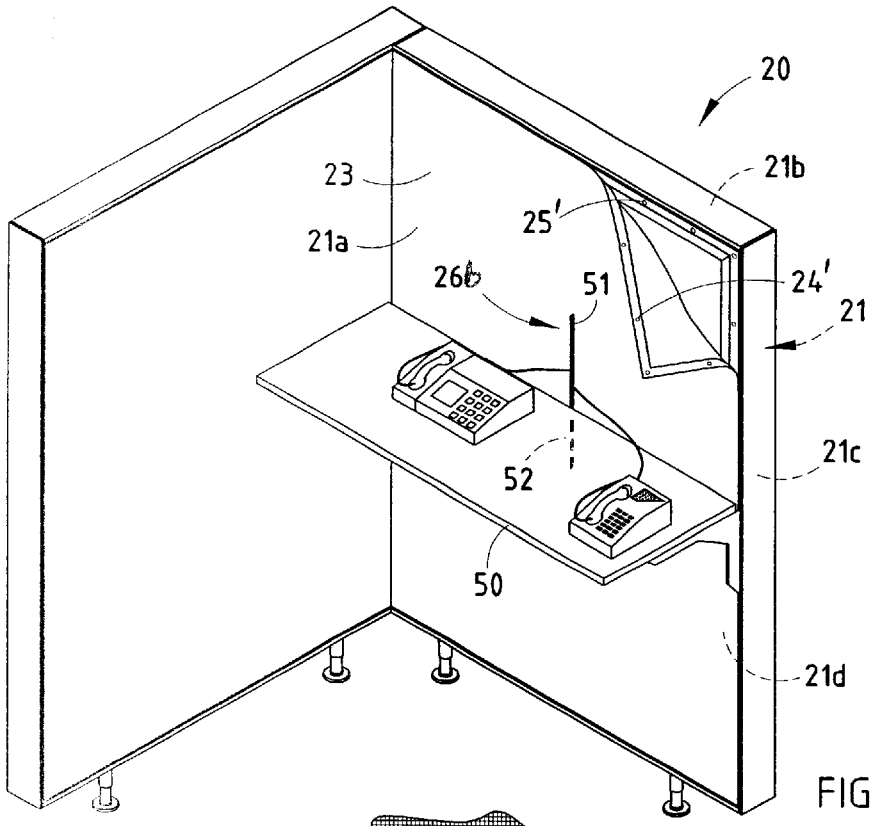
FIG. 5 is a perspective view similar to FIG. 2, but of a modified covering having a vertically extending access opening.

The access slit does not need to extend horizontally, nor does it need to be limited to one location or orientation in a given covering. FIG. 5 illustrates a vertically oriented slit 26*b* which includes upper and lower portions 51 and 52 that extend above and below a worksurface 50. The slit could also be L-shaped, such that a triangular flap of the covering would open when the slit was unzipped. Alternatively, it is contemplated that the slit could extend at an angle between vertical and horizontal orientations.

Figure 6:
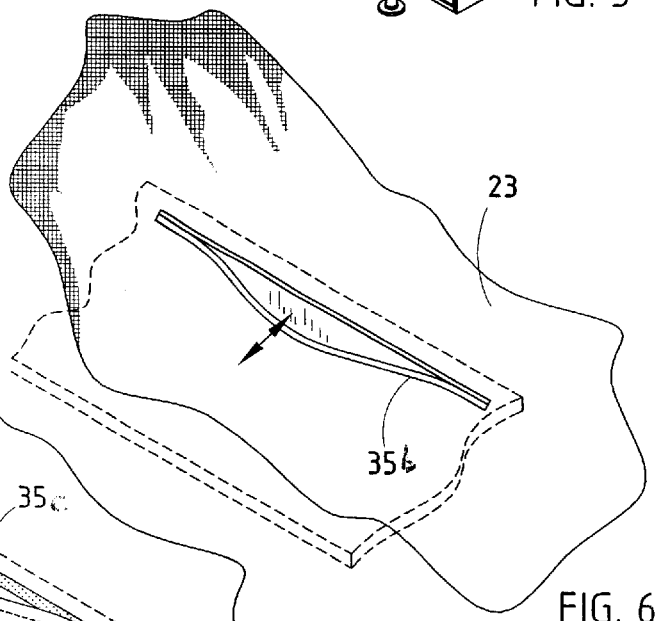
FIGS. 6–7 are perspective views of modified coverings having closable access slits.
Figure 7:
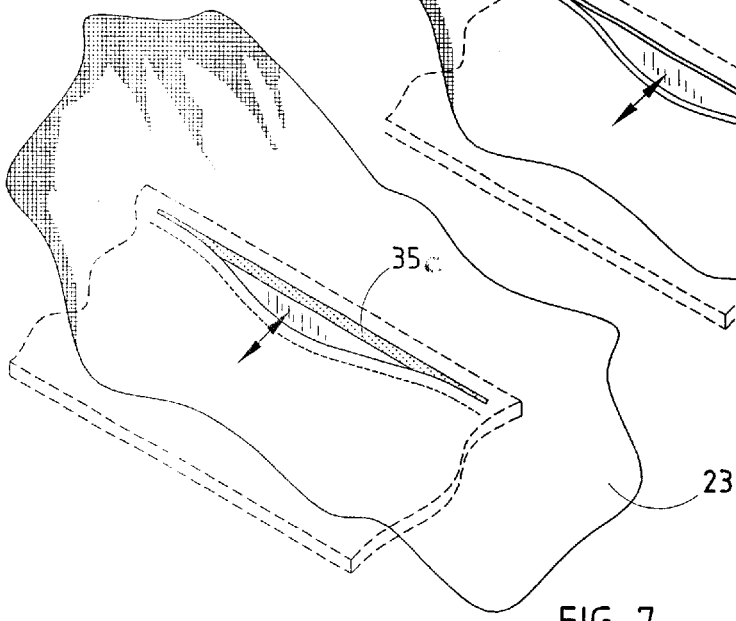

It is contemplated that the access slit 26 can use different closure devices. For example, the zipper (35) can be replaced with a stiff strip of resilient material 35*b* (FIG. 6), such as a strip of spring steel that is shaped to naturally bias the slit 26 to a closed position. Alternatively, hook and loop material 35*c* (FIG. 7) attached to overlapping flanges can be used, and/or snaps can be used. Still further, overlapping stiffened flanges can be used without hook and loop material, with the top flange being the outermost flange such that the top flange hangs down to visually cover and hide the slide from view of a person standing next to the partition 20.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. In a reconfigurable panel system having a plurality of individual panels detachably interconnected in a side-by-side relationship to partition open office space into individual workstations, the improvement of a partition comprising:

a partition frame having a face and a cavity behind the face;

a covering attached to the partition frame that aesthetically covers the face, the covering including an access slit through which the cavity can be accessed, the covering being sufficiently flexible so that the slit can be opened to access the cavity.

2. The panel system as defined in claim 1, wherein the access slit extends horizontally.

3. The panel system as defined in claim 2, including a worksurface positioned next to the covering, with the access slit being located above but proximate a top of the worksurface.

4. The panel system as defined in claim 3, wherein the worksurface is attached to the partition.

5. The panel system as defined in claim 1, wherein at least a portion of the covering is removably attached to the partition.

6. The panel system as defined in claim 5, wherein the covering includes a corner section attached to partition frame by hook-and-loop material.

7. The panel system as defined in claim 1, including a closure mechanism in the slit constructed to control opening and closing of the slit.

8. The panel system as defined in claim 7, wherein the closure mechanism includes a zipper located along access slit.

9. The panel system as defined in claim 7, wherein the closure mechanism includes first and second zipper elements on the zipper so that an operator can selectively locate where wires go into the access slit even when the access slit is substantially closed.

10. The panel system as defined in claim 7, wherein the closure mechanism includes hook-and-loop material located along the access slit.

11. The panel system as defined in claim 7, wherein the closure mechanism includes a resilient strip that bends with an over-center motion between open and closed positions.

12. The panel system as defined in claim 1, including a pouch located inside the cavity, the pouch including walls connected to top and bottom edges of material forming the access slit.

13. The panel system as defined in claim 12, including an electrical device positioned near the access slit, the electrical device including excess wires located in and extending from the pouch.

14. The panel system as defined in claim 1, wherein the partition includes receptacles located inside the cavity near the access slit.

15. The panel system as defined in claim 1, including a first pouch attached to the covering and having a first mouth located along the access slit for receiving wiring for electrical power, and including a second pouch attached to the covering and having a second mouth located along the access slit for receiving telecommunication wiring.

16. The panel system as defined in claim 1, wherein the access slit extends vertically.

17. The panel system as defined in claim 1, wherein at least a portion of the access slit is located at a height of at least about 18 inches, so that the access slit can be efficiently used in combination with a seated person.

18. A partition comprising:

a partition frame having a face and a cavity behind the face; and a covering attached to the partition frame that aesthetically covers the face, the covering including an access opening through which the cavity can be accessed and a pouch shaped and adapted to hold items in the cavity that are dropped through the access opening.

19. The partition defined in claim 18, wherein the pouch is located in the cavity of the partition.

20. A method comprising steps of:

providing a partition frame having a face and a cavity behind the face, a covering with an access opening for the cavity, and a pouch in the cavity that is shaped and adapted to hold items placed in the cavity;

providing a worksurface adjacent the partition frame; and supporting an electrical appliance on the worksurface, including placing excess wiring from the electrical appliance through the access opening into the pouch.

21. A partition comprising:

a partition frame having a face and a cavity behind the face;

a covering attached to the partition frame that aesthetically covers the face, the covering including an access slit through which the cavity can be accessed, the covering being sufficiently flexible so that the slit can be opened to access the cavity; wherein:

the access slit extends horizontally; and including a worksurface positioned next to the covering, with the access slit being located above but proximate a top of the worksurface.

22. The partition as defined in claim 21, wherein the worksurface is attached to the partition.

23. A partition comprising:

a partition frame having a face and a cavity behind the face;

a covering attached to the partition frame that aesthetically covers the face, the covering including an access slit through which the cavity can be accessed, the cover being sufficiently flexible so that the slit can be opened to access the cavity; and wherein the partition includes receptacles located inside the cavity near the access slit.

24. A partition comprising:

a partition frame having a face and a cavity behind the face;

a covering attached to the partition frame that aesthetically covers the face, the covering including an access slit through which the cavity can be accessed, the covering being sufficiently flexible so that the slit can be opened to access the cavity; and including a first pouch attached to the covering and having a first mouth located along the access slit for receiving wiring for electrical power, and including a second pouch attached to the covering and having a second mouth located along the access slit for receiving telecommunication wiring.

25. A partition comprising:

a partition frame having a face and a cavity behind the face;

a covering attached to the partition frame that aesthetically covers the face, the covering including an access slit through which the cavity can be accessed, the covering being sufficiently flexible so that the slit can be opened to access the cavity; and including a pouch located inside the cavity, the pouch including walls connected to top and bottom edges of material forming the access slit.

26. The partition as defined in claim 25, including an electrical device positioned near the access slit, the electrical device including excess wires located in and extending from the pouch.

* * * * *